US010529304B2

(12) United States Patent
Imamura et al.

(10) Patent No.: US 10,529,304 B2
(45) Date of Patent: Jan. 7, 2020

(54) LID OPENING AND CLOSING APPARATUS AND KEYBOARD INSTRUMENT

(71) Applicant: CASIO COMPUTER CO., LTD., Shibuya-ku, Tokyo (JP)

(72) Inventors: Naoto Imamura, Akishima (JP); Ryohei Kawada, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/231,531

(22) Filed: Dec. 23, 2018

(65) Prior Publication Data

US 2019/0206372 A1 Jul. 4, 2019

(30) Foreign Application Priority Data

Dec. 28, 2017 (JP) ..... 2017-254089

(51) Int. Cl.
*G10C 3/02* (2006.01)
*G10H 1/32* (2006.01)
*G10C 3/12* (2006.01)

(52) U.S. Cl.
CPC ..... *G10C 3/02* (2013.01); *G10C 3/12* (2013.01); *G10H 1/32* (2013.01)

(58) Field of Classification Search
CPC ..... G10C 3/02; G10C 3/12; G10H 1/32
See application file for complete search history.

(56) References Cited

U.S. PATENT DOCUMENTS 5,429,026 A * 7/1995 Kimura ..... E06B 5/006 84/179
7,495,158 B2 * 2/2009 Nagatsuma ..... G10C 3/02 84/179
8,841,528 B2 9/2014 Hoshino
2013/0305900 A1 * 11/2013 Nagatsuma ..... G10C 3/12 84/423 R
2013/0305901 A1 11/2013 Hoshino
2019/0206372 A1 * 7/2019 Imamura ..... G10C 3/12

FOREIGN PATENT DOCUMENTS

DE 10163352 A1 7/2003
JP H08115075 A 5/1996
JP H08115076 A 5/1996
JP 2000250529 A 9/2000
JP 2013238796 A 11/2013

OTHER PUBLICATIONS

Extended European Search Report (EESR) dated May 22, 2019 issued in counterpart European Application No. 18214998.9.

* cited by examiner

*Primary Examiner* — Robert W Horn
(74) *Attorney, Agent, or Firm* — Holtz, Holtz & Volek PC

(57) ABSTRACT

A lid opening and closing apparatus including a lid, a shaft guide member which has a guide groove, a front side guide shaft which is provided on a front side of the lid and moved along the guide groove, a first braking member whose at least one portion is arranged on a movement trajectory of the front side guide shaft, and which brakes a closing movement of the lid, and a second braking member which brakes movement of the one portion of the first braking member which occurs by the front side guide shaft pressing the one portion of the first braking member on the movement trajectory when the closing movement is made.

18 Claims, 7 Drawing Sheets

LID OPENING AND CLOSING APPARATUS AND KEYBOARD INSTRUMENT

CROSS-REFERENCE TO RELATED APPLICATION

This application is based upon and claims the benefit of priority from the prior Japanese Patent Application No. 2017-254089, filed Dec. 28, 2017, the entire contents of which are incorporated herein by reference.

BACKGROUND OF THE INVENTION

1. Field of the Invention

The present invention relates to a lid opening and closing apparatus that is used in a musical instrument such as a keyboard instrument, and a keyboard instrument equipped with the lid opening and closing apparatus.

2. Description of the Related Art

For example, a keyboard instrument is known which has a structure where an opening and closing lid that openably and closably covers a keyboard section is rotatably attached by hinges to a musical instrument case mounted with the keyboard section, and a shock absorber is provided on the front part of the musical instrument case, whereby impact due to the closing of the opening and closing lid is absorbed by the shock absorber when the opening and closing lid is closed to cover the keyboard section, as shown in Japanese Patent Application Laid-Open (Kokai) Publication No. 08-115075.

In this keyboard instrument having the structure where the opening and closing lid has been rotatably attached to the musical instrument case by the hinges, strong impact occurs by the closing of the opening and closing lid. Therefore, the shock absorber is required to absorb such strong impact.

An object of the present invention is to provide a lid opening and closing apparatus by which a lid can be favorably opened or closed, and a keyboard instrument equipped with the lid opening and closing apparatus.

SUMMARY OF THE INVENTION

In accordance with one aspect of the present invention, there is provided a lid opening and closing apparatus comprising: a lid; a shaft guide member which has a guide groove; a front side guide shaft which is provided on a front side of the lid and moved along the guide groove; a first braking member whose at least one portion is arranged on a movement trajectory of the front side guide shaft, and which brakes a closing movement of the lid; and a second braking member which brakes movement of the one portion of the first braking member which occurs by the front side guide shaft pressing the one portion of the first braking member on the movement trajectory when the closing movement is made.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The present invention can be more clearly understood by the detailed description below when considered together with the following drawings.

DETAILED DESCRIPTION OF THE PREFERRED EMBODIMENT

An embodiment where the present invention has been applied in an electronic keyboard instrument will hereinafter be described with reference to FIG. 1 to FIG. 7.

Figure 1:
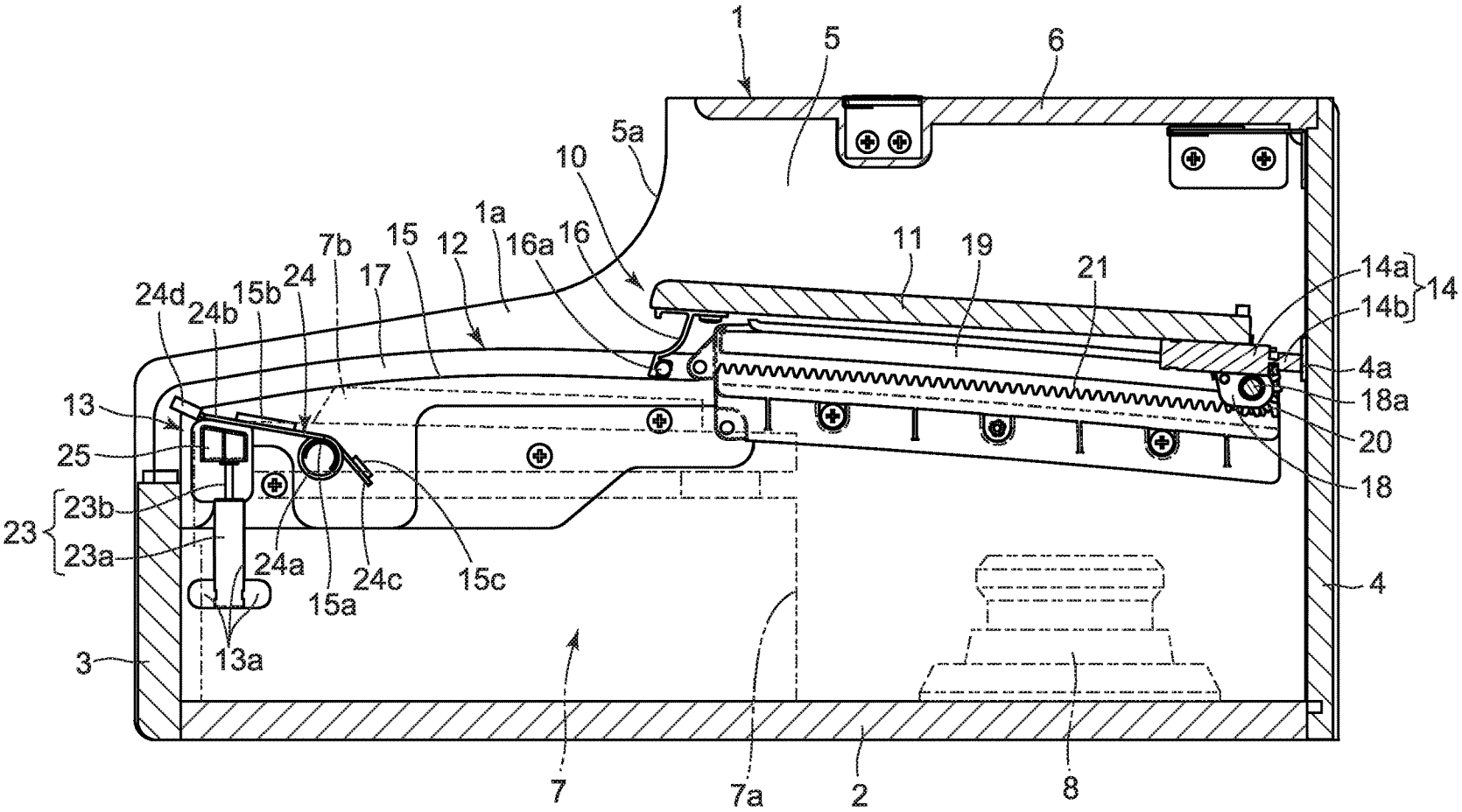
FIG. 1 is a cross-sectional view showing an opened state of an opening and closing lid in an embodiment where the present invention has been applied in an electronic keyboard instrument.
Figure 2:
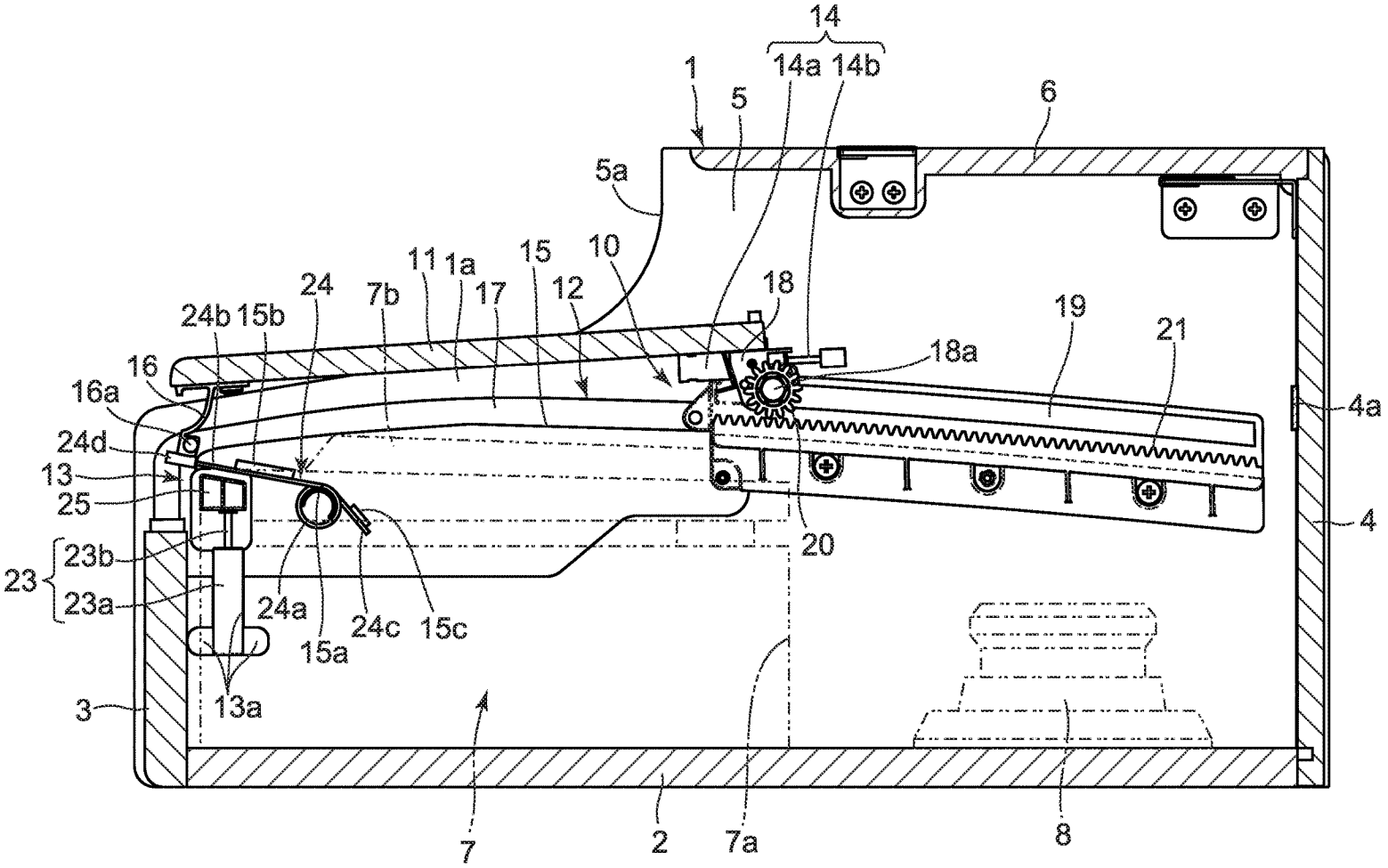
FIG. 2 is a cross-sectional view showing a state before the opening and closing lid completely covers a keyboard section in the electronic keyboard instrument shown in FIG. 1.
Figure 3:
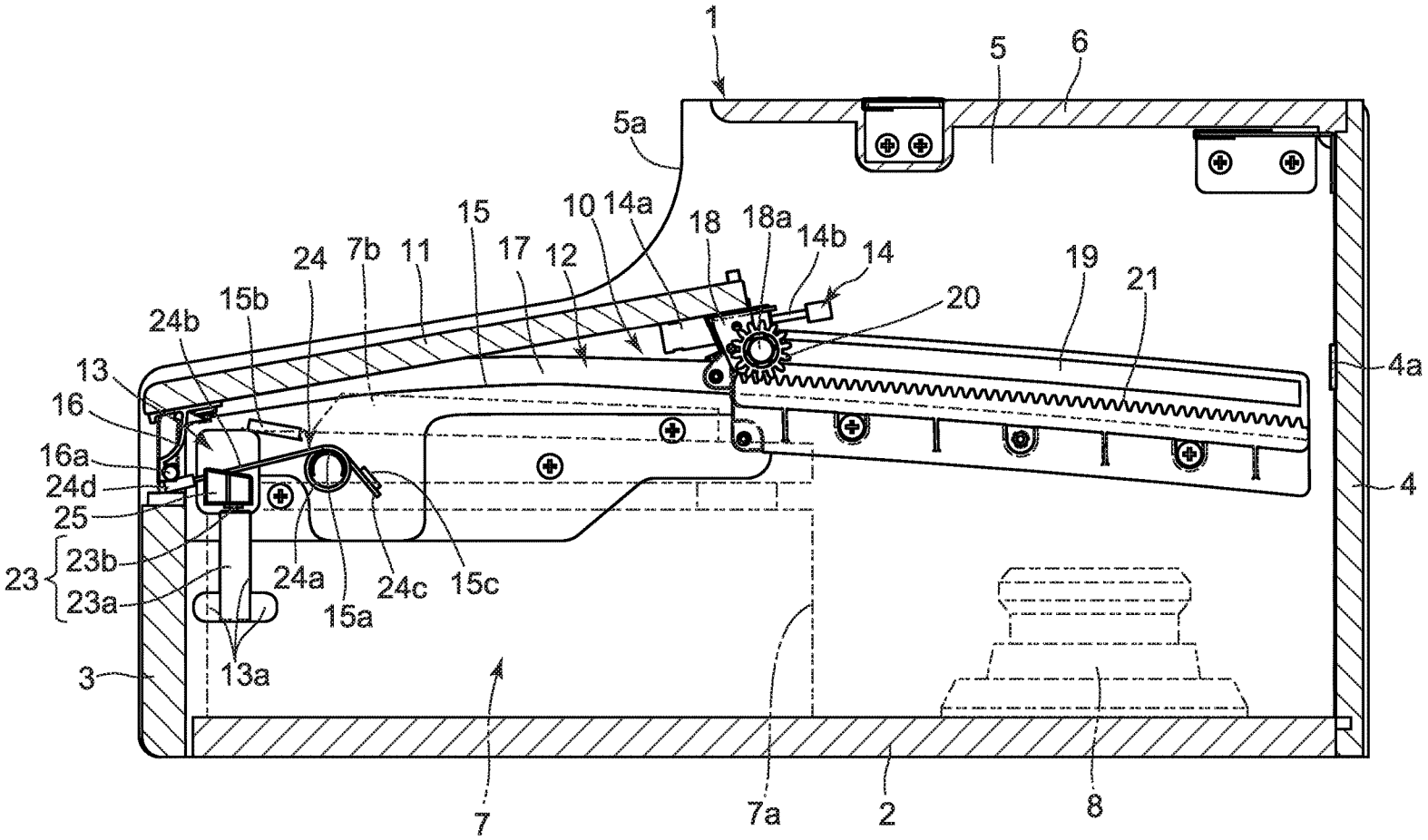
FIG. 3 is a cross-sectional view showing a state after the opening and closing lid completely covers the keyboard section in the electronic keyboard instrument shown in FIG. 2.

This electronic keyboard instrument includes a musical instrument case 1, as shown in FIG. 1 to FIG. 3. The musical instrument case 1 is formed in a substantially box shape whose length in a lateral direction orthogonal to a front-rear direction is large. More specifically, this musical instrument case 1 includes a bottom plate 2, a front plate 3 provided upright on the front end of the bottom plate 2, a rear plate 4 provided upright on the rear end of the bottom plate 2, a pair of side plates 5 provided upright on both sides of the bottom plate 2, and a top plate 6 arranged on the upper ends of the pair of side plates 5 and the rear plate 4.

The rear plate 4 is formed such that its height is greater than that of the front plate 3, as shown in FIG. 1 to FIG. 3. Each of the pair of side plates 5 is formed such that the height from its middle portion to its front portion in the front-rear direction (left-right direction in FIG. 1 to FIG. 3) is slightly greater than that of the front plate 3 and the height from its middle portion to its rear portion is substantially the same as that of the rear plate 4. As a result, a stepped section 5*a* is formed at the middle portion of each of the pair of side plates 5 in the front-rear direction, so that each side plate 5 is structured such that its upper portion in front of the stepped section 5*a* is mildly sloped forward and downward.

The length of the top plate 6 in the front-rear direction is substantially the same as that of the rear part of each side plate 5 excluding the stepped section 5*a*, and the top plate 6 is mounted on the upper end of the rear part of each side plate 5 and the upper end of the rear plate 4, as shown in FIG. 1 to FIG. 3. As a result, the musical instrument case 1 has an opening section 1*a* which is located in front of the top plate 6 and whose upper part is open, and has a substantially box shape which is long in the lateral direction orthogonal to the front-rear direction.

In the musical instrument case 1, a keyboard section 7 and speakers 8 are provided, as shown in FIG. 1 to FIG. 3. The keyboard section 7 has a structure where a plurality of keys 7*b* has been arrange on a keyboard chassis 7*a*, and is arranged on the front side of the musical instrument case 1. The plurality of keys 7*b* of the keyboard section 7 is exposed forward and upward from the opening section 1*a* of the musical instrument case 1. The speakers 8, which emit musical sounds, are arranged on both sides in the rear part of the musical instrument case 1.

Also, in the musical instrument case 1, a lid opening and closing apparatus 10 is provided, as shown in FIG. 1 to FIG. 3. This lid opening and closing apparatus 10 includes an opening and closing lid 11 which openably and closably covers the keyboard section 7, guide members 12 each of which is a shaft guide member for movably guiding the opening and closing lid 11, front side braking members 13 each of which brakes the closing movement of the opening and closing lid 11 when the opening and closing lid 11 is guided by the guide members 12 and closed to cover the keyboard section 7, rear side braking members 14 each of which brakes the opening movement of the opening and closing lid 11 when the opening and closing lid 11 is guided by the guide members 12 and moved above the keyboard section 7 so as to be housed in the musical instrument case 1.

The opening and closing lid 11 is a flat plate, as shown in FIG. 1 to FIG. 3. The length of the opening and closing lid 11 in the front-rear direction is slightly higher than the length between the upper part of the front plate 3 and each stepped section 5*a* at the middle portion of each side plate 5, and the length of the opening and closing lid 11 in the lateral direction orthogonal to the front-rear direction is substantially the same as the length between the pair of side plates 5. As a result, the opening and closing lid 11 openably and closably covers the keyboard section 7 with it being arranged above the keyboard section 7 and covering the opening section 1*a* of the musical instrument case 1.

Each guide member 12 includes a guide plate 15 whose front portion is fitted into one of the pair of side plate 5, as shown in FIG. 1 to FIG. 3 and FIG. 5 to FIG. 7. Each guide plate 15 has a front side guide groove 17 which guides a front side guide shaft 16*a* of a front side support section 16 provided on the lower front end of the opening and closing lid 11, and a rear side guide groove 19 which guides a rear side guide shaft 18*a* of a rear side support section 18 provided on the lower rear end of the opening and closing lid 11.

Each front side guide shaft 16*a* provided on the opening and closing lid 11 is long in the arrangement direction (the right-left direction of the keyboard instrument) of the plurality of keys 7*b* included in the keyboard section 7. One end 24*d* of each spring member 24 that is a first braking member is arranged on the trajectory of a movement to be made by the corresponding front side guide shaft 16*a* in the corresponding front side guide groove 17 in response to the opening or closing of the opening and closing lid 11. The movement speed of this front side guide shaft 16*a* varies between before and after its contact with the corresponding first braking member. That is, the movement speed decreases after the contact. The movement of each front side guide shaft 16*a* is braked by the corresponding spring member 24 (first braking member) and the corresponding first damper section 23 (second braking member).

Each front side guide groove 17 is provided such that it is vertically extended upward from an area near the upper part of the front plate 3, and then mildly and posterosuperiorly inclined and extended toward the rear part of the musical instrument case 1 along the upper end of the corresponding side plate 5 until it reaches an area under the rear part of the stepped section 5*a* located at the middle portion of the side plate 5, that is, an area under the front part of the top plate 6, as shown in FIG. 1 to FIG. 3.

The front end of each rear side guide groove 19 is in an area that is located under the front part of the top plate 6 and above the rear end of the corresponding front side guide groove 17. That is, each rear side guide groove 19 is provided such that it is mildly and posteroinferiorly inclined and extended toward the rear part of the musical instrument case 1 until it comes close to the rear plate 4, as shown in FIG. 1 to FIG. 3.

As a result, when the opening and closing lid 11 is guided by the guide members 12 so as to be closed to cover the keyboard section 7, the guide members 12 decrease the speed of the closing movement of the opening and closing lid 11 by the front side guide shafts 16*a* descending along the front side guide grooves 17 inclined anteroinferiorly toward the front side and the rear side guide shafts 18*a* ascending along the rear side guide grooves 19 inclined anterosuperiorly toward the front side, as shown in FIG. 1 to FIG. 3.

Also, when the opening and closing lid 11 is guided above the keyboard section 7 so as to be moved into and housed in the musical instrument case 1, the guide members 12 decrease the speed of the opening movement of the opening and closing lid 11 by the rear side guide shafts 18*a* descending along the rear side guide grooves 19 inclined posteroinferiorly toward the rear side and the front side guide shafts 16*a* ascending along the front side guide grooves 17 inclined posterosuperiorly toward the rear side, as shown in FIG. 1 to FIG. 3.

Also, each guide member 12 includes a guide rack 21 where a pinion 20 attached to the rear side guide shaft 18*a* of the corresponding rear side support section 18 on the lower rear end of the opening and closing lid 11 is meshed and moved while being rotated, as shown in FIG. 1 to FIG. 3. Each guide rack 21 is a member for smoothly moving the corresponding rear side guide shaft 18*a* of the opening and closing lid 11, in the corresponding rear side guide groove 19, and is provided below the rear side guide groove 19 of the corresponding guide plate 15 along and in parallel with it.

The front side braking members 13 include the spring members 24 each of which is a first braking member whose one end 24*d* is arranged on the trajectory 17 of a movement to be made by the corresponding front side guide shaft 16*a* and brakes the closing movement of the opening and closing lid 11, and the first damper sections 23 each of which is a second braking member arranged in an attachment concave section 13*a* provided in a portion of the corresponding side plate 5 of the musical instrument case 1 near the front part of the corresponding guide member 12, as shown in FIG. 1 to FIG. 7.

Figure 4:
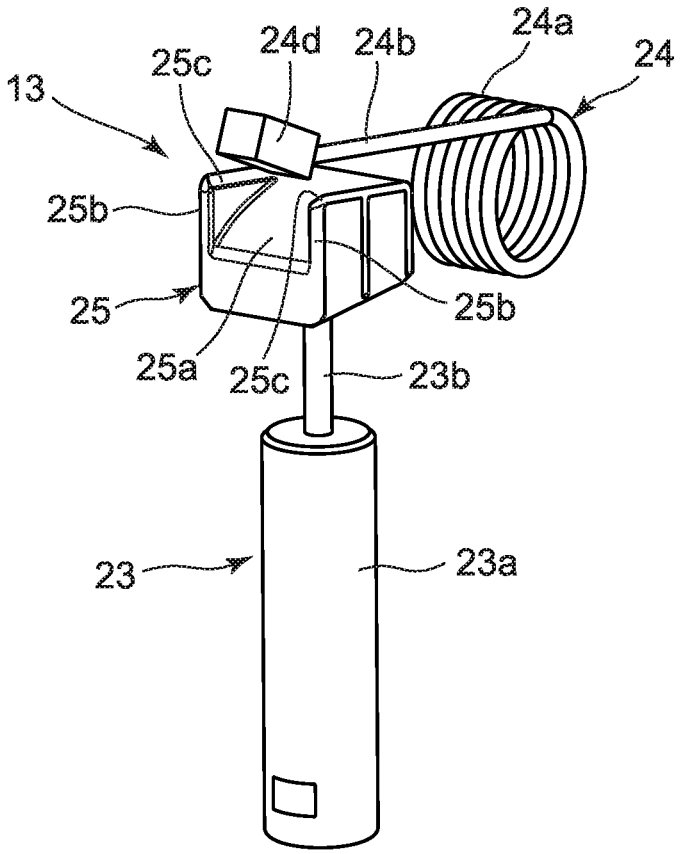
FIG. 4 is an enlarged perspective view of a main part, which is a second braking member in the electronic keyboard instrument shown in FIG. 1.
Figure 5:
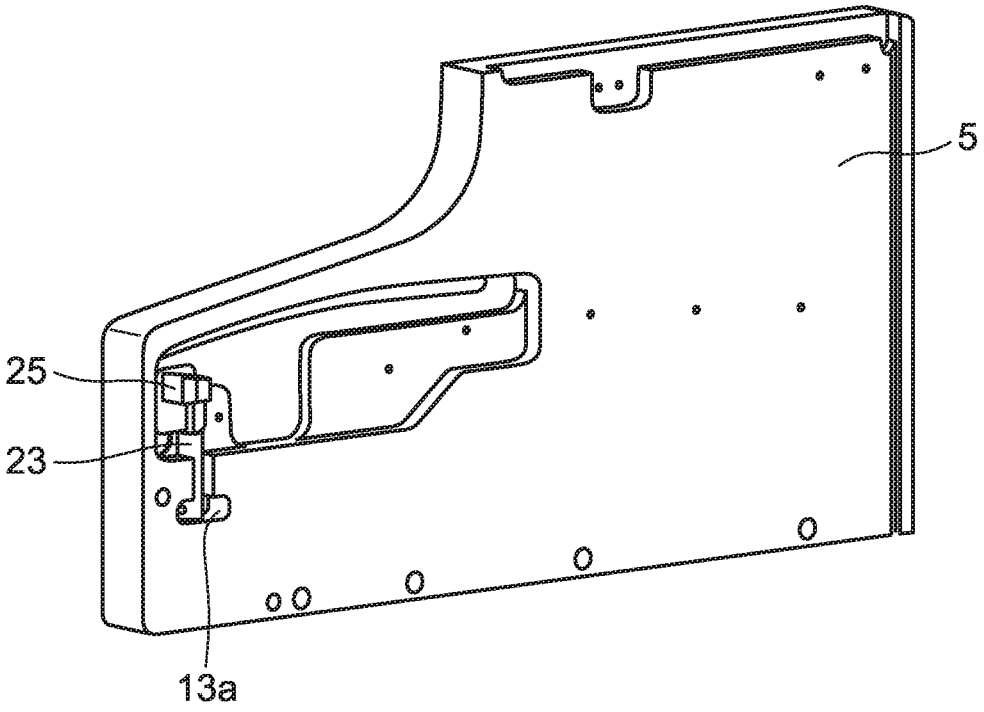
FIG. 5 is a perspective view showing the second braking member arranged in a concave portion in the left side plate of the electronic keyboard instrument shown in FIG. 1.
Figure 6:
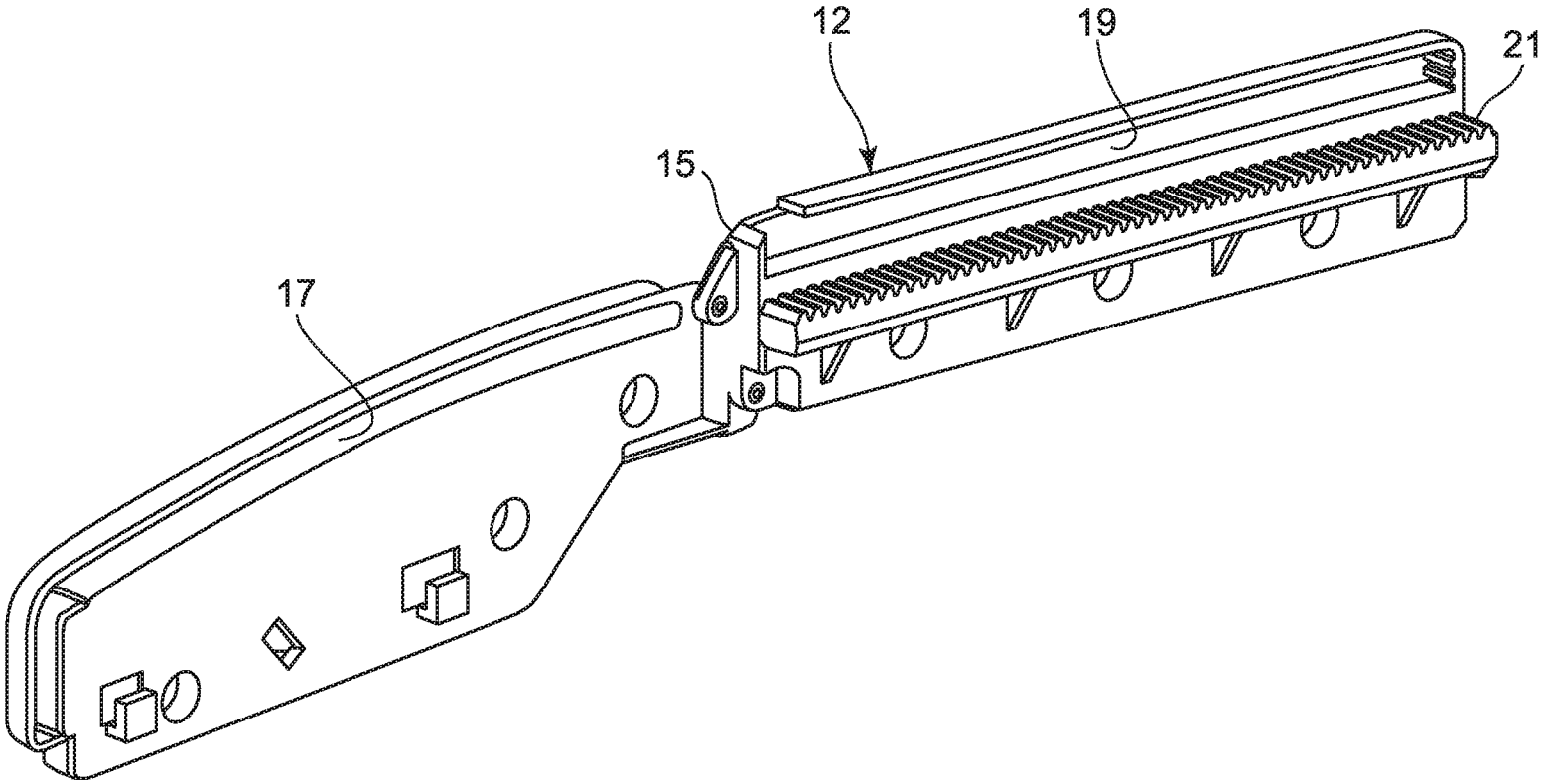
FIG. 6 is a perspective view showing the right side surface of a guide member which is fitted into the concave portion of the side plate in FIG. 5 and guide grooves.

Each first damper section 23 is an oil damper, and brakes the resilient deformational movement of one end portion 24*b* of the corresponding spring member 24 pressed by the corresponding front side guide shaft 16*a* when the opening and closing lid 11 is closed, as shown in FIG. 4. More specifically, each first damper section 23 includes a cylindrical damper body 23*a* and a rod 23*b* slidably inserted into the damper body 23*a* such that its outer end portion protrudes externally.

The upper part of the damper body 23*a* is arranged in the attachment concave section 13*a* on the corresponding guide plate 15 side, so that the movement of the damper body 23*a* in the lateral direction orthogonal to the front-rear direction of the musical instrument case 1, that is, the right-left direction of the musical instrument case 1 is restricted, as shown in FIG. 1 to FIG. 5. Accordingly, when the outer end of the rod 23*b* is pressed by the one end portion 24*b* of the spring member 24, the rod 23*b* is slowly moved backward into the damper body 23*a* fixed to the musical instrument case 1, whereby the resilient deformational movement of the one end portion 24*b* of the spring member 24 is braked by the first damper section 23.

Each spring member 24 is a torsion coil spring, as shown in FIG. 1 to FIG. 4 and FIG. 7. The coil section 24*a* of each spring member 24 is held by a first holding section 15*a* provided on each guide plate 15. The one end portion 24*b* of each spring member 24 extends above the corresponding first damper section 23, comes in contact from below with a second holding section 15*b* provided on each guide plate 15, and is held thereby. The other end portion 24*c* of each spring member 24 extends toward the side opposite to the one end portion 24*b*, comes in contact from below with a third holding section 15*c* provided on each guide plate 15, and is held thereby.

As a result, in each spring member 24, when the one end portion 24*b* is displaced downward from the second holding section 15*b* of the corresponding guide plate 15 with the coil section 24*a* held by the first holding section 15*a* as a fulcrum, the rod 23*b* of the corresponding first damper section 23 is depressed by the one end portion 24*b*.

Also, the leading end of the one end portion 24*b* of each spring member 24 extends to an area corresponding to the front side guide groove 17 of the corresponding guide member 12, that is, an area included in the movement trajectory of the corresponding front side guide shaft 16*a* of the opening and closing lid 11, with it being positioned above the corresponding first damper section 23, as shown in FIG. 1 to FIG. 3 and FIG. 6 to FIG. 7. On this leading end of the one end portion 24*b*, a rubber cap 24*d* with which the corresponding front side guide shaft 16*a* comes in contact is provided.

Also, each first damper section 23 includes a damper cap 25 which is provided on the outer end of the rod 23*b* and pressed by the one end portion 24*b* of the corresponding spring member 24, as shown in FIG. 1 to FIG. 4. On both sides of the upper surface 25*a* of this damper cap 25, a pair of guide walls 25*b* is provided. By this pair of guide walls 25*b*, the one end portion 24*b* of the spring member 24 can be guided to and pressed against the upper surface 25*a* of the damper cap 25 without deviating therefrom.

On the upper end of each guide wall 25*b*, an inclined guide section 25*c* is provided which guides the one end portion 24*b* of the spring member 24 toward the inner surface side of the pair of guide walls 25*b*, as shown in FIG. 4. These guide sections 25*c* are inclined toward the inner side of the guide walls 25*b* from upper outer portions of the guide walls 25*b*.

Figure 7:
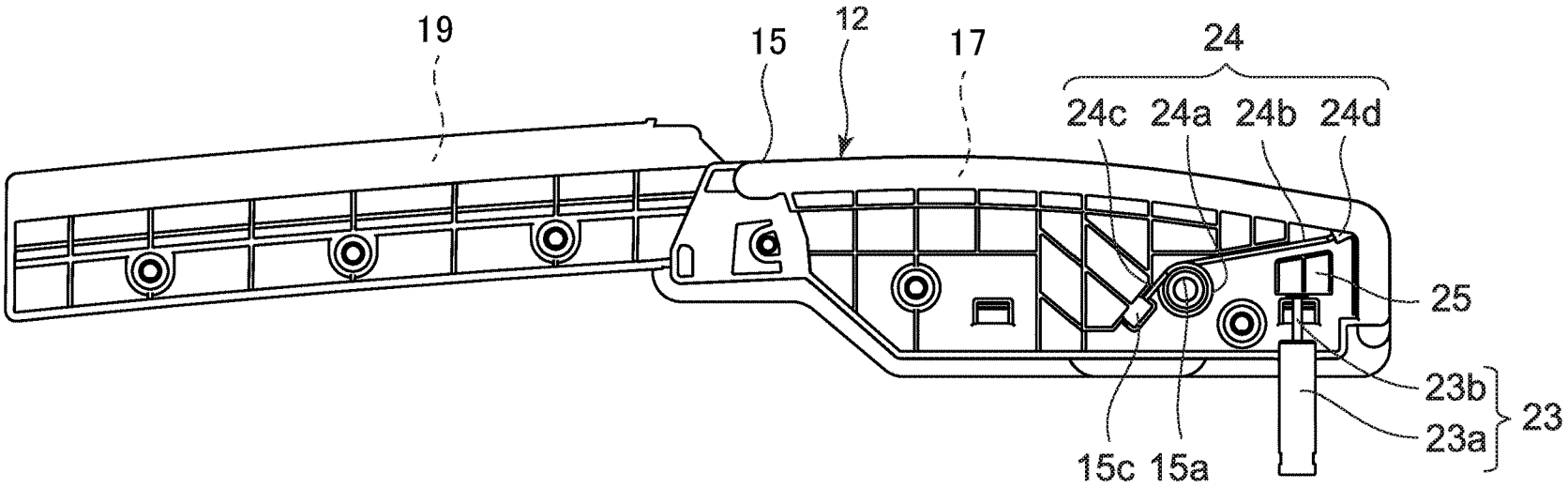
FIG. 7 is a diagram showing the attachment state of a spring member on the left side surface of the guide member in FIG. 6, and a relation between the spring member and a first damper section.

As a result, in the case of the first damper section 23 provided on the side plate 5 on the left side of the musical instrument case 1, the pair of guide walls 25*b* guides the one end portion 24*b* of the corresponding spring member 24 by one inclined guide section 25*c* located on the inner side of the musical instrument case 1, that is, the inclined guide section 25*c* located on the right side in FIG. 4, and thereby arranges the one end portion 24*b* between the pair of guide walls 25*b*, as shown in FIG. 7.

Also, in the case of the first damper section 23 provided on the side plate 5 on the right side of the musical instrument case 1, the pair of guide walls 25*b* guides the one end portion 24*b* of the corresponding spring member 24 by the other inclined guide section 25*c* located on the inner side of the musical instrument case 1, that is, the inclined guide section 25*c* located on the left side in FIG. 4, and thereby arranges the one end portion 24*b* between the pair of guide walls 25*b*, as shown in FIG. 7.

Also, the height of the front end portion of each guide wall 25*b* on the front side of the musical instrument case 1 is higher than that of the rear end portion, as shown in FIG. 1 to FIG. 3. That is, the upper end of each guide wall 25*b* is posteroinferiorly inclined from the front side toward the rear side, by which the pair of guide walls 25*b* brings the one end portion 24*b* of the corresponding spring member 24 to an area between them when the one end portion 24*b* of the spring member 24 is pressed by the corresponding front side guide shaft 16*a* and resiliently displaced.

As described above, when the one end portion 24*b* of each spring member 24 is pressed by the corresponding front side guide shaft 16*a* of the opening and closing lid 11 and comes in contact with the corresponding first damper section 23 while being resiliently deformed, the damper cap 25 thereof guides the one end portion 24*b* of the spring member 24 by the pair of guide walls 25*b*, so that the one end portion 24*b* is pressed against the upper surface 25*a* of the damper cap 25, as shown in FIG. 3.

The upper surface 25*a* of this damper cap 25 is formed to be a curved guide surface having a shape tailored to the resilient displacement of the one end portion 24*b* of the spring member 24 which occurs when the one end portion 24*b* is resiliently displaced with the coil section 24*a* as a fulcrum, as shown in FIG. 4. Note that the upper surface 25*a* of the damper cap 25 should preferably be formed to be a curved guide surface by which the contact position of the one end portion 24*b* of the spring member 24 when the one end portion 24*b* is resiliently displaced is located on the central axis of the rod 23*b* of the first damper section 23.

As a result of the above-described structure, in the front side braking members 13, when the front side guide shafts 16*a* of the opening and closing lid 11 come in contact from above with the rubber caps 24*d* on the one end portions 24*b* of the spring members 24 by the opening and closing lid 11 being guided by the guide members 12 and closed to cover the keyboard section 7, the one end portions 24*b* of the spring members 24 are resiliently and flexurally deformed by the weight of the opening and closing lid 11, as shown in FIG. 2 and FIG. 3.

That is, in each front side braking member 13, when the one end portion 24*b* of the spring member 24 is resiliently and flexurally deformed with the coil section 24*a* as a fulcrum by the weight of the opening and closing lid 11, this one end portion 24*b* is pressed against the damper cap 25 of the first damper section 23, and the rod 23*b* of the first damper section 23 is slowly moved backward into the damper body 23*a*, whereby the closing movement of the opening and closing lid 11 is braked, as shown in FIG. 2 and FIG. 3.

Here, in each front side braking member 13, the upper surface 25*a* of the damper cap 25 is a curved guide surface having a shape tailored to the resilient displacement of the one end portion 24*b* of the spring member 24. Accordingly, the rod 23*b* of the first damper section 23 is favorably pressed into the damper body 23*a* when the one end portion 24*b* of the spring member 24 is pressed against the damper cap 25 of the first damper section 23, as shown in FIG. 2 to FIG. 4.

Also, the front side braking members 13 are structured such that, when the opening and closing lid 11 is to be moved into the musical instrument case 1 via an area above the keyboard section 7, the front side guide shafts 16*a* of the opening and closing lid 11 are pushed upward by the spring force of the spring members 24, as shown in FIG. 2 and FIG. 3. Accordingly, even though the front end portion of the front side guide groove 17 of each guide member 12 is substantially vertically extending upward from the area near the upper part of the front plate 3, the front end of the opening and closing lid 11 can be pushed upward with light force.

On the other hand, each rear side braking member 14 is a second damper section provided on the undersurface of the rear part of the opening and closing lid 11, and brakes the opening movement of the opening and closing lid 11 when the opening and closing lid 11 guided by the guide members 12 is housed in the musical instrument case 1 so as to expose the keyboard section 7, as shown in FIG. 1 to FIG. 3. More specifically, each rear side braking member 14 is an oil damper as with the first damper section 23 of each front side braking member 13, and includes a cylindrical damper body 14*a* and a rod 14*b* slidably inserted into the damper body 14*a* such that its outer end portion protrudes externally.

Each rear side braking member 14 brakes the opening movement of the opening and closing lid 11 by the rod 14*b* being slowly moved backward into the damper body 14*a* when the outer end portion of the rod 14*b* which is externally protruding is pressed against the rear plate 4 of the musical instrument case 1, as shown in FIG. 1 to FIG. 3. On the inner surface of the rear plate 4 of the musical instrument case 1, buffer sections 4*a* are provided which are made of rubber or the like and with which the outer end portions of the rods 14*b* come in contact.

That is, each rear side braking member 14 brakes the opening movement of the opening and closing lid 11 by the outer end portion of the rod 14*b* being pressed against the corresponding buffer section 4*a* on the inner surface of the rear plate 4 of the musical instrument case 1 immediately before the opening and closing lid 11 is completely housed in the musical instrument case 1 so as to expose the keyboard section 7, and by the rod 14*b* being slowly moved backward into the damper body 14*a*, as shown in FIG. 1 to FIG. 3.

Next, the mechanism of the lid opening and closing apparatus 10 of this electronic keyboard instrument is described.

When the keyboard section 7 is to be covered by the opening and closing lid 11, first, the opening and closing lid 11 housed in the musical instrument case 1 is pulled out of the musical instrument case 1. Here, the front side guide shafts 16*a* of the opening and closing lid 11 are moved to descend the slopes of the front side guide grooves 17 of the guide members 12 along the front side guide grooves 17, and the rear side guide shafts 18*a* of the opening and closing lid 11 are moved to ascend the slopes of the rear side guide grooves 19 of the guide members 12 along the rear side guide grooves 19.

As such, when the opening and closing lid 11 is to be closed to cover the keyboard section 7, the rear side guide shafts 18*a* of the opening and closing lid 11 are moved to ascend the slopes of the rear side guide grooves 19 along the rear side guide grooves 19. Accordingly, even though the front side guide shafts 16*a* of the opening and closing lid 11 are moved to descend the slopes of the front side guide grooves 17 along the front side guide grooves 17, the opening and closing lid 11 is not moved at high speed. That is, by the guide members 12, the closing movement of the opening and closing lid 11 is braked, so that the speed thereof is decreased. As a result, the opening and closing lid 11 is moved slowly.

Then, immediately before the opening and closing lid 11 enters a closed state of covering the keyboard section 7, the front side guide shafts 16*a* of the opening and closing lid 11 are pressed against the rubber caps 24*d* provided on the one end portions 24*b* of the spring members 24 of the front side braking members 13. Here, the one end portion 24*b* of each spring member 24 is resiliently and flexurally deformed with the coil section 24*a* as a fulcrum. As a result, the movement speed of the opening and closing lid 11 is further decreased and the one end portions 24*b* of the spring members 24 are pressed against the damper caps 25 of the first damper sections 23.

Here, since the heights of the front end portions of the guide walls 25*b* of each damper cap 25 are higher than those of the rear end portions, and the inclined guide sections 25*c* have been formed on the upper ends of the pair of guide walls 25*b*, the one end portion 24*b* of each spring member 24 is guided by the corresponding pair of guide walls 25*b* and unfailingly pressed against the upper surface 25*a* of the corresponding damper cap 25.

Also, since the upper surface 25*a* of each damper cap 25 has been formed to be a curved guide surface having a shape tailored to the resilient displacement of the one end portion 24*b* of the corresponding spring member 24, the one end portion 24*b* of each spring member 24 is favorably pressed against the upper surface 25*a* of the corresponding damper cap 25 even when resiliently and flexurally displaced with the coil section 24*a* as a fulcrum. Accordingly, the rods 23*b* are favorably and unfailingly pressed into the damper bodies 23*a*.

When the rods 23*b* of the first damper sections 23 are pressed by the one end portions 24*b* of the spring members 24, each rod 23*b* is slowly moved backward into the corresponding damper body 23*a*. That is, by each first damper section 23, the resilient displacement of the one end portion 24*b* of each spring member 24 is unfailingly and favorably braked. As a result, the closing movement of the opening and closing lid 11 is braked, whereby the opening and closing lid 11 is slowly closed. That is, the opening and closing lid 11 is closed safely.

On the other hand, when the opening and closing lid 11 is to be housed in the musical instrument case 1 so as to expose the keyboard section 7, the opening and closing lid 11 arranged above the keyboard section 7 is pressed into the musical instrument case 1. Here, the front side guide shafts 16*a* of the opening and closing lid 11 are being pushed upward by the spring force of the spring members 24. Therefore, although the front ends of the front side guide grooves 17 of the guide members 12 are substantially vertically extending upward from the area near the upper part of the front plate 3, the front end of the opening and closing lid 11 can be pushed upward with light force.

Then, the front side guide shafts 16*a* of the opening and closing lid 11 are moved to ascend the slopes of the front side guide grooves 17 of the guide members 12 along the front side guide grooves 17, and the rear side guide shafts 18*a* of the opening and closing lid 11 are moved to descend the slopes of the rear side guide grooves 19 of the guide member 12 along the rear side guide grooves 19. Accordingly, the opening and closing lid 11 can be moved with light force.

Also, although the rear side guide shafts 18*a* of the opening and closing lid 11 are moved to descend the slopes of the rear side guide grooves 19 along the rear side guide grooves 19, the opening and closing lid 11 is not moved at high speed because the front side guide shafts 16*a* of the opening and closing lid 11 are moved to descend the slopes of the front side guide groove 17 along the front side guide groove 17. That is, by the guide members 12, the opening movement of the opening and closing lid 11 is braked, so that the speed thereof is decreased. As a result, the opening and closing lid 11 is moved slowly.

Then, immediately before the opening and closing lid 11 is completely housed in the musical instrument case 1 so as to expose the keyboard section 7, the rear side braking members 14 provided on the undersurface of the rear part of the opening and closing lid 11 brake the opening movement of the opening and closing lid 11. That is, in each rear side braking member 14, the outer end of the rod 14*b* is pressed against the corresponding buffer section 4*a* on the rear plate 4 of the musical instrument case 1 immediately before the opening and closing lid 11 is completely housed in the musical instrument case 1, whereby the rod 14*b* is slowly moved backward into the damper body 14*a*. As a result, the opening movement of the opening and closing lid 11 is braked.

As described above, the lid opening and closing apparatus 10 of the electronic keyboard instrument includes the opening and closing lid 11, the guide members 12 that are shaft guide members having the front side guide grooves 17, the front side guide shafts 16*a* which are provided on the front side of the opening and closing lid 11 and moved along the front side guide grooves 17, the spring members 24 each of which is a first braking member whose one end portion 24*b* is arranged on the trajectory of a movement to be made by the corresponding front side guide shaft 16*a* and which brakes the closing movement of the opening and closing lid 11, and the first damper sections 23 each of which is a second braking member that brakes the resilient displacement of the one end portion 24*b* of the corresponding spring member 24 occurred by the corresponding front side guide shaft 16*a* pressing the one end portion 24*b* on the movement trajectory. Therefore, the opening and closing lid 11 can be favorably opened or closed.

More specifically, this lid opening and closing apparatus 10 includes the spring members 24 whose one end portions 24*b* are each arranged on the trajectory of a movement to be made by the corresponding front side guide shaft 16*a* and which brake the closing movement of the opening and closing lid 11 when the opening and closing lid 11 is closed to cover the keyboard section 7. Accordingly, by the spring force of the spring members 24, the closing movement of the opening and closing lid 11 can be unfailingly and favorably braked and decelerated before the front side guide shafts 16*a* of the opening and closing lid 11 are pressed against the first damper sections 23. As a result, the impact of the opening and closing lid 11 on the first damper sections 23 can be buffered.

Here, each spring member 24 is a torsion coil spring, of which the coil section 24*a* is held by the corresponding first holding section 15*a* of the musical instrument case 1. The one end portion 24*b* thereof extends above the corresponding first damper section 23 and is held by the corresponding second holding section 15*b* of the musical instrument case 1. The other end portion 24*c* thereof extends toward the side opposite to the one end portion 24*b* and is held by the corresponding third holding section 15*c* of the musical instrument case 1. Accordingly, when the one end portions 24*b* of the spring members 24 are pressed by the front side guide shafts 16*a* of the opening and closing lid 11 and separated from the second holding sections 15*b*, the spring members 24 are resiliently deformed, whereby the closing movement of the opening and closing lid 11 can be unfailingly and favorably braked.

Also, the rubber caps 24*d* with which the front side guide shafts 16*a* come in contact are provided on the leading ends of the one end portions 24*b* of the spring members 24. Accordingly, by these rubber caps 24*d*, impact when the front side guide shafts 16*a* come in contact with the one end portions 24*b* of the spring members 24 can be buffered, so that the occurrence of impact sound can be prevented, and the opening and closing lid 11 can be favorably closed.

Moreover, in this lid opening and closing apparatus 10, the first damper sections 23 are provided on the musical instrument case 1 in a manner to correspond to the front parts of the guide members 12. Therefore, when the one end portions 24*b* of the spring members 24 are pressed against the first damper sections 23 via the damper caps 25 immediately before the opening and closing lid 11 guided by the guide members 12 are closed to cover the keyboard section 7, the closing movement of the opening and closing lid 11 is braked by the first damper sections 23, so that the opening and closing lid 11 can be closed safely.

Here, the first damper section 23 of each front side braking member 13 is an oil damper, and includes the cylindrical damper body 23*a* and the rod 23*b* slidably inserted into the damper body 23*a* such that its outer end portion protrudes externally. Therefore, when the one end portions 24*b* of the spring members 24 resiliently displaced by being pressed by the front side guide shafts 16*a* of the opening and closing lid 11 are pressed against the rods 23*b*, the rods 23*b* are slowly moved backward into the damper bodies 23*a*, whereby the closing movement of the opening and closing lid 11 can be unfailingly and favorably braked.

Also, each first damper section 23 includes the damper cap 25 which guides the one end portion 24*b* of the corresponding spring member 24 when this one end portion 24*b* is resiliently displaced by being pressed by the corresponding front side guide shaft 16*a* of the opening and closing lid 11 and comes in contact with the corresponding first damper section 23. Accordingly, when the one end portions 24*b* of the spring members 24 are pressed and resiliently displaced by the front side guide shafts 16*a* of the opening and closing lid 11 with the coil sections 24*a* of the spring members 24 as fulcrums, these one end portions 24*b* of the spring members 24 can be unfailingly and favorably pressed against the first damper sections 23 by the damper caps 25.

Also, the upper surface 25*a* of each damper cap 25 is a curved guide surface having a shape tailored to the resilient displacement of the one end portion 24*b* of the corresponding spring member 24 which is occurred when the one end portion 24*b* is resiliently displaced with the corresponding coil section 24*a* as a fulcrum. Accordingly, the one end portions 24*b* of the spring members 24 can be unfailingly and favorably pressed against the first damper sections 23 when they are resiliently displaced.

Moreover, on both sides of the upper surface 25*a* of each damper cap 25 which is a curved guide surface, the pair of guide walls 25*b* is provided which guides the one end portion 24*b* of the corresponding spring member 24 toward the curved guide surface. Accordingly, by this pair of guide walls 25*b*, the one end portion 24*b* of each spring member 24 can be guided when resiliently displaced and pressed against the corresponding damper cap 25. As a result of this structure, the one end portion 24*b* of each spring member 24 can be unfailingly and favorably guided to and pressed against the upper surface 25*a* of the corresponding damper cap 25 without deviating therefrom.

Furthermore, on the upper ends of the pair of guide walls 25*b* of each damper cap 25, the inclined guide sections 25*c* are provided which guide the one end portion 24*b* of the corresponding spring member 24 toward the inner surface side of the pair of guide walls 25*b*. Accordingly, by these inclined guide sections 25*c*, the one end portion 24*b* of each spring member 24 can be unfailingly and favorably guided toward an area between the corresponding pair of guide walls 25*b* when the one end portion 24*b* is resiliently displaced and pressed against the corresponding damper cap 25. As a result, the one end portion 24*b* of each spring member 24 can be unfailingly and favorably guided to and pressed against the upper surface 25*a* of the corresponding damper cap 25.

Still further, the heights of the front end portions of the guide walls 25*b* of each damper cap 25 on the front side of the musical instrument case 1 are higher than those of the rear end portions. Accordingly, by the inclined guide sections 25*c*, the one end portion 24*b* of each spring member 24 can be unfailingly and favorably guided toward an area between the corresponding pair of guide walls 25*b* when the one end portion 24*b* is resiliently displaced and pressed against the corresponding damper cap 25. As a result, the one end portion 24*b* of each spring member 24 can be unfailingly and favorably guided to and pressed against the upper surface 25*a* of the corresponding damper cap 25.

Also, the lid opening and closing apparatus 10 includes the rear side braking members 14 each of which is a rear side braking member that brakes the opening movement of the opening and closing lid 11 immediately before the opening and closing lid 11 guided by the guide members 12 is housed in the musical instrument case 1 so as to expose the keyboard section 7. Accordingly, in this lid opening and closing apparatus 10, the opening movement of the opening and closing lid 11 can be unfailingly and favorably braked when the opening and closing lid 11 is housed in the musical instrument case 1, whereby the safety is ensured.

That is, each rear side braking member 14 is a second damper section provided on the rear part of the opening and closing lid 11, and brakes the opening movement of the opening and closing lid 11 immediately before the opening and closing lid 11 guided by the guide members 12 is housed in the musical instrument case 1 so as to expose the keyboard section 7. Accordingly, in this lid opening and closing apparatus 10, the opening movement of the opening and closing lid 11 can be unfailingly and favorably braked when the opening and closing lid 11 is housed in the musical instrument case 1, whereby the safety is ensured.

Also, each rear side braking member 14 is an oil damper as with the first damper section 23 of each front side braking member 13, and includes the cylindrical damper body 14*a* and the rod 14*b* slidably inserted into the damper body 14*a* such that its outer end portion protrudes externally. Accordingly, in this lid opening and closing apparatus 10, when the outer end portions of the rods 14*b* are pressed against the buffer sections 4*a* on the rear plate 4 of the musical instrument case 1, the rods 14*b* are slowly moved backward into the damper bodies 14*a*, whereby the opening movement of the opening and closing lid 11 can be unfailingly and favorably braked.

Also, in this lid opening and closing apparatus 10, the guide members 12 are provided on the musical instrument case 1, and decrease the movement speed of the opening and closing lid 11 when movably guiding the opening and closing lid 11. More specifically, in each guide member 12, the front side guide groove 17 which guides the corresponding front side guide shaft 16*a* on the front part of the opening and closing lid 11 is provided such that it is posterosuperiorly inclined from the front side toward the rear side, and the rear side guide groove 19 which guides the corresponding rear side guide shaft 18*a* on the rear part of the opening and closing lid 11 is provided such that it is posteroinferiorly inclined from the front side toward the rear side. Therefore, in this lid opening and closing apparatus 10, the speed of the opening or closing movement of the opening and closing lid 11 can be decreased when the opening and closing lid 11 is moved to expose or cover the keyboard section 7, so that the opening and closing lid 11 can be moved safely.

That is, in this lid opening and closing apparatus 10, when the opening and closing lid 11 is to be closed to cover the keyboard section 7, the rear side guide shafts 18*a* of the opening and closing lid 11 are moved to ascend the slopes of the rear side guide grooves 19 along the rear side guide grooves 19. Accordingly, even though the front side guide shafts 16*a* of the opening and closing lid 11 are moved to descend the slopes of the front side guide grooves 17 along the front side guide grooves 17, the opening and closing lid 11 is not moved at high speed. That is, in this lid opening and closing apparatus 10, the closing movement of the opening and closing lid 11 is braked by the guide members 12, so that the speed thereof is decreased. As a result the opening and closing lid 11 can be moved slowly and safely.

Also, in this lid opening and closing apparatus 10, when the opening and closing lid 11 is to be opened to expose the keyboard section 7, the front side guide shafts 16*a* of the opening and closing lid 11 are moved to ascend the slopes of the front side guide grooves 17 along the front side guide grooves 17. Accordingly, even though the rear side guide shafts 18*a* of the opening and closing lid 11 are moved to descend the slopes of the rear side guide grooves 19 along the rear side guide grooves 19, the opening and closing lid 11 is not moved at high speed. That is, in this lid opening and closing apparatus 10, the opening movement of the opening and closing lid 11 is braked by the guide members 12, so that the speed thereof is decreased. As a result, the opening and closing lid 11 can be moved slowly and safely.

While the present invention has been described with reference to the preferred embodiments, it is intended that the invention be not limited by any of the details of the description therein but includes all the embodiments which fall within the scope of the appended claims.

What is claimed is:

1. A lid opening and closing apparatus comprising:

a lid;

a shaft guide member which has a guide groove;

a front side guide shaft which is provided on a front side of the lid and is movable along the guide groove;

a first braking member at least one portion of which is arranged on a movement trajectory of the front side guide shaft, and which brakes a closing movement of the lid; and a second braking member which brakes movement of the at least one portion of the first braking member which occurs by the front side guide shaft pressing the at least one portion of the first braking member while moving on the movement trajectory when the closing movement is made.

2. The lid opening and closing apparatus according to claim 1, wherein the second braking member comprises a damper section which brakes movement of the at least one portion of the first braking member, and a damper cap which transmits a movement force of the at least one portion of the first braking member to an upper end of the damper section.

3. The lid opening and closing apparatus according to claim 2, wherein the damper cap has guide walls which guide movement of the at least one portion of the first braking member in an inner surface direction of the guide walls.

4. The lid opening and closing apparatus according to claim 3, wherein each guide wall has an inclined guide section which is provided on an upper end thereof and guides the one portion of the first braking member in the inner surface direction of the guide walls.

5. The lid opening and closing apparatus according to claim 3, wherein a front part of each guide wall in a front-rear direction of the lid has a height higher than a height of a rear part of each guide wall.

6. The lid opening and closing apparatus according to claim 3, wherein each guide wall has an inclined guide section which is provided on an upper end thereof and guides the one portion of the first braking member in the inner surface direction of the guide walls, and wherein a front part of each guide wall in a front-rear direction of the lid has a height higher than a height of a rear part of each guide wall.

7. The lid opening and closing apparatus according to claim 1, wherein the shaft guide member restricts movement of the second braking member in a horizontal direction.

8. The lid opening and closing apparatus according to claim 2, wherein the first braking member comprises a spring member including (i) a first end portion having a rubber cap at least one portion of which is arranged on the movement trajectory of the front side guide shaft, (ii) a second end portion which is held by a holding section provided on the shaft guide member, and (iii) a coil section which is held by a shaft provided on the shaft guide member, and wherein an upper surface of the damper cap comprises a curved surface tailored to movement of the at least one end portion of the first braking member.

9. The lid opening and closing apparatus according to claim 1, further comprising:

a rear side braking member which is provided behind the lid and brakes the closing movement of the lid when the lid is closed by being guided by the shaft guide member.

10. A keyboard instrument comprising:

a keyboard;

a lid which openably and closably covers the keyboard;

a shaft guide member which has a guide groove;

a front side guide shaft which is provided on a front side of the lid and is movable along the guide groove;

a first braking member at least one portion of which is arranged on a movement trajectory of the front side guide shaft, and which brakes a closing movement of the lid; and a second braking member which brakes movement of the at least one portion of the first braking member which occurs by the front side guide shaft pressing the at least one portion of the first braking member while moving on the movement trajectory when the closing movement is made.

11. The keyboard instrument according to claim 10, wherein the second braking member comprises a damper section which brakes movement of the at least one portion of the first braking member, and a damper cap which transmits a movement force of the one portion of the first braking member to an upper end of the damper section.

12. The keyboard instrument according to claim 11, wherein the damper cap has guide walls which guide movement of the at least one portion of the first braking member in an inner surface direction of the guide walls.

13. The keyboard instrument according to claim 12, wherein each guide wall has an inclined guide section which is provided on an upper end thereof and guides the one portion of the first braking member in the inner surface direction of the guide walls.

14. The keyboard instrument according to claim 12, wherein a front part of each guide wall in a front-rear direction of the lid has a height higher than a height of a rear part of each guide wall.

15. The keyboard instrument according to claim 12, wherein each guide wall has an inclined guide section which is provided on an upper end thereof and guides the one portion of the first braking member in the inner surface direction of the guide walls, and wherein a front part of each guide wall in a front-rear direction of the lid has a height higher than a height of a rear part of each guide wall.

16. The keyboard instrument according to claim 10, wherein the shaft guide member restricts movement of the second braking member in a horizontal direction.

17. The keyboard instrument according to claim 11, wherein the first braking member comprises a spring member including (i) a first end portion having a rubber cap at least one portion of which is arranged on the movement trajectory of the front side guide shaft, (ii) a second end portion which is held by a holding section provided on the shaft guide member, and (iii) a coil section which is held by a shaft provided on the shaft guide member, and wherein an upper surface of the damper cap comprises a curved surface tailored to movement of the at least one end portion of the first braking member.

18. The keyboard instrument according to claim 10, further comprising:

a rear side braking member which is provided behind the lid and brakes the closing movement of the lid when the lid is closed by being guided by the shaft guide member.

* * * * *